US011230751B2

(12) United States Patent
Sernik et al.

(10) Patent No.: US 11,230,751 B2
(45) **Date of Patent: *Jan. 25, 2022**

(54) PROCESSES FOR PRODUCING LOW NITROGEN METALLIC CHROMIUM AND CHROMIUM-CONTAINING ALLOYS AND THE RESULTING PRODUCTS

(71) Applicant: Companhia Brasileira de Metalurgia e Mineração, Araxá (BR)

(72) Inventors: Kleber A. Sernik, Greensburg, PA (US); Alaércio Salvador Martins Vieira, Araxá (BR); Adriano Porfirio Rios, Araxá (BR); Daniel Pallos Fridman, Araxá (BR)

(73) Assignee: Companhia Brasileira de Metalurgia e Mineracão, State of Minas Gerais (BR)

( * ) Notice: Subject to any disclaimer, the term of this patent is extended or adjusted under 35 U.S.C. 154(b) by 113 days.

This patent is subject to a terminal disclaimer.

(21) Appl. No.: 16/122,692

(22) Filed: Sep. 5, 2018

(65) Prior Publication Data

US 2019/0003013 A1 Jan. 3, 2019

Related U.S. Application Data

(60) Continuation of application No. 15/463,217, filed on Mar. 20, 2017, now abandoned, which is a division of application No. 14/533,741, filed on Nov. 5, 2014, now Pat. No. 10,041,146.

(51) Int. Cl.

| | |
|---|---|
| ***C22B 34/32*** | (2006.01) |
| ***C22B 5/04*** | (2006.01) |
| ***C22B 9/04*** | (2006.01) |
| ***C22C 1/06*** | (2006.01) |
| ***C22C 19/05*** | (2006.01) |
| ***C22C 1/04*** | (2006.01) |
| ***C22C 27/06*** | (2006.01) |

(52) U.S. Cl.

CPC ..... *C22B 34/32* (2013.01); *C22B 5/04* (2013.01); *C22B 9/04* (2013.01); *C22C 1/045* (2013.01); *C22C 1/06* (2013.01); *C22C 19/05* (2013.01); *C22C 27/06* (2013.01)

(58) Field of Classification Search

CPC .... C22B 5/00; C22B 5/02; C22B 5/04; C22B 5/18; C22B 9/00; C22B 9/003; C22B 9/006; C22B 9/04; C22B 9/05; C22B 9/055; C22B 9/14; C22B 9/16; C22B 9/18; C22B 9/20; C22B 34/30; C22B 34/32; C22B 34/325; C22C 1/02; C22C 1/06; C22C 27/06; C22C 30/00; C22C 30/02; C22C 30/04; C22C 30/06

See application file for complete search history.

(56) References Cited

U.S. PATENT DOCUMENTS

| | | | |
|---|---|---|---|
| 2,953,443 | A | 9/1960 | Lloyd |
| 4,150,975 | A | 4/1979 | Miyake et al. |
| 4,169,722 | A | 10/1979 | Fletcher |
| 4,331,475 | A | 5/1982 | Perfect |
| 4,612,047 | A | 9/1986 | Schmidt et al. |
| 4,917,726 | A | 4/1990 | Chou et al. |
| 4,994,236 | A | 2/1991 | Mihalisin et al. |
| 5,086,720 | A | 2/1992 | Gibran |
| 5,092,921 | A | 3/1992 | Kobayashi et al. |
| 5,196,048 | A | 3/1993 | Antrim et al. |
| 5,259,866 | A | 11/1993 | Kobayashi et al. |
| 5,364,587 | A | 11/1994 | Perfect |
| 5,422,069 | A | 6/1995 | Perfect |
| 6,458,182 | B2 | 10/2002 | Shindo et al. |
| 7,361,205 | B2 | 4/2008 | Liebaert |
| 8,496,046 | B2 | 7/2013 | Nakayama et al. |
| 9,771,634 | B2 | 9/2017 | Sernik |
| 10,041,146 | B2 | 8/2018 | Sernik et al. |

(Continued)

FOREIGN PATENT DOCUMENTS

| | | | |
|---|---|---|---|
| CN | 1176233 | A | 3/1998 |
| CN | 1394974 | A | 2/2003 |

(Continued)

OTHER PUBLICATIONS

Japanese Office Action dated Oct. 15, 2019, issued during the prosecution of Japanese Patent Application No. JP2017-522510.
Rejection Decision dated Jul. 19, 2019 and issued by the China National Intellectual Property Administration in Chinese Application No. 201580060203.2 and translation.
Extended European Search Report dated Jul. 24, 2019 issued in EPO Application No. 19168262.4.
Chilean Office Action dated Apr. 9, 2019 issued in Chilean App. No. 201701134.
Chilean Office Action dated Mar. 25, 2019 issued in Chilean App. No. 201701132.

(Continued)

*Primary Examiner* — Vanessa T. Luk

(74) *Attorney, Agent, or Firm* — Locke Lord LLP; Alicia J. Carroll

(57) ABSTRACT

Processes for producing low-nitrogen metallic chromium or chromium-containing alloys, which prevent the nitrogen in the surrounding atmosphere from being carried into the melt and being absorbed by the metallic chromium or chromium-containing alloy during the metallothermic reaction, include vacuum-degassing a thermite mixture comprising metal compounds and metallic reducing powders contained within a vacuum vessel, igniting the thermite mixture to effect reduction of the metal compounds within the vessel under reduced pressure i.e., below 1 bar, and conducting the entire reduction reaction in said vessel under reduced pressure, including solidification and cooling, to produce a final product with a nitrogen content below 10 ppm. The final products obtained, in addition to low-nitrogen metallic chromium in combination with other elements, can be used as raw materials in the manufacture of superalloys, stainless steel and other specialty steels whose final content of nitrogen is below 10 ppm.

12 Claims, No Drawings

(56) References Cited

U.S. PATENT DOCUMENTS

| | | | |
|---|---|---|---|
| 2005/0061109 | A1 | 3/2005 | Liebaert |
| 2006/0110626 | A1 | 5/2006 | Ziani et al. |
| 2012/0034127 | A1 | 2/2012 | Harris |
| 2012/0217433 | A1 | 8/2012 | Yokoyama et al. |
| 2015/0354031 | A1 | 12/2015 | Gehrmann et al. |
| 2016/0122848 | A1 | 5/2016 | Sernik et al. |
| 2016/0122853 | A1 | 5/2016 | Sernik |
| 2017/0121792 | A1 | 5/2017 | Sernik |
| 2017/0191145 | A1 | 7/2017 | Sernik |

FOREIGN PATENT DOCUMENTS

| | | | |
|---|---|---|---|
| CN | 101440436 | | 5/2009 |
| CN | 102965526 | A | 3/2013 |
| CN | 105624436 | A | 6/2016 |
| DE | 69920925 | T2 | 3/2006 |
| EP | 0236505 | A1 | 9/1987 |
| EP | 426375 | A1 | 5/1991 |
| EP | 0482808 | A1 | 4/1992 |
| GB | 220459 | A | 8/1924 |
| GB | 2204595 | A | 11/1988 |
| JP | 52036508 | A | 3/1977 |
| JP | S57-029542 | A | 2/1982 |
| JP | S63199832 | A | 8/1988 |
| JP | H01-119634 | A | 5/1989 |
| JP | 19891040899 | | 9/1989 |
| JP | H03-146625 | A | 6/1991 |
| JP | H04160124 | A | 6/1992 |
| JP | 2002193607 | A | 7/2002 |
| JP | 04193784 | B2 | 12/2008 |
| JP | 2012-177140 | A | 9/2012 |
| RU | 2214471 | C2 | 10/2003 |

OTHER PUBLICATIONS

Chinese Office Action dated Feb. 3, 2019 issued in CN App. No. 201580060203.2 and English translation.

Examination Report issued in Singapore Application No. 11201702030T dated Feb. 11, 2019.

Final Office Action issued in U.S. Appl. No. 15/403,273 dated Jul. 9, 2019.

International Search Report and Written Opinion dated Jul. 20, 2016 in connection with PCT/IB2015/002635.

X. S. Xie, et al., "Research and Development of Inconel 718 Type Superalloy", Materials Science Forum, vols. 593-543, Mar. 15, 2007, pp. 262-269.

Perfect, F.H,: "Aluminothermic Chromium and Chromium Alloys, Low in Nitrogen," American Society for Metals and the Metallurgical Society of AIME, vol. 12B, pp. 611-612, Sep. 1981.

W. Singer et al.: "RRR-Measurement Techniques on High Purity Niobium," TTC-Report Feb. 2010, pp. 1-17, 2010.

Habashi, Fathi,"Metallothermic Reactions—a Short History," CIM Magazine, May 2012, pp. 1-2.

M. Vincent & Associates, Ltd., Specialty Metals: "Chemical Data, Mechanical Properties and Specification for Nickel Alloy C-276". Copyright 2016.

M. Vincent & Associates, Ltd., Specialty Metals: "Chemical Data, Mechanical Properties and Specification for Nickel Alloy C-22". Copyright 2016.

SAEAeropace—Aerospace Material Specification—Nickel Alloy, Corrosion and Heat-Resistant, Bars, Forgings, and Rings 52.5Ni—19Cr—3.0Mo—5.1 Cb (Nb)—0.90TI—0.50Ai—18Fe Consumable Electrode or Vacuum Induction Melted 1775° F. (968° C.) Solution Heat Treated, precipitation-Hardenable. AMS 5662M Issued: Sep. 1965, Revised Jul. 2004, Reaffirmed Jun. 2009.

API Standard 6A718: "Nickel Base Alloy 718 (UNS N07718) for Oil and Gas Driling and Production Equipment," Second Edition, Dec. 2009, Errata, Apr. 1, 2010.

JP1040899B—English translation of Abstract only.

Min et al., "Modern Nickel Superalloys and the Efficient Resource-Saving Technologies of Their Production", Russian Metallurgy, vol. 2015, No. 13, pp. 1060-1068, 2015.

Choudhury, "State of the Art of Superalloy Production For Aerospace And Other Application Using VIN/VAR or VIM/ESR", ISIJ International, vol. 32, No. 5, pp. 563-574, Jan. 1, 1992.

Weber, "Nickel-based Superalloys: Alloying Methods and Thermomechanical Processing", The Concise Encyclopedia of Materials Processing, pp. 6149-6154, Jan. 1, 2009.

PCT International Search Report and Written Opinion dated Aug. 24, 2016, issued during the prosecution of PCT International Patent Application No. PCT/IB2015/002636 (12 pages).

Mitchell, et al., "Solidification and Precipitation in IN718", Superalloys 718, 625, 706 and Various Derivatives, ed. E.A. Loria, The Minerals, Metals & Materials Society, 2001.

Mitchell et al., "The Precipitation of Primary Carbides in Alloy 718", Superalloys 718, 625, 706 and Various Derivatives, ed. E.A. Loria, The Minerals, Metals & Material Society, 1994.

AMS 5662 Rev. N, Issued: Sep. 1965, Reaffirmed: Jun. 2009, Revised Jun. 2016; SAE International.

European Office Action dated Feb. 20, 2018, issued during the prosecution of European Patent Application No. 15/864318.9 (4 pages).

Perfect, F. H., "Metallothermic Reduction of Oxides in Water-Cooled Copper Furnaces", Transactions of the Metallurgical Society of AIME, Sep. 1967, pp. 1282-1286, vol. 239, No. 9, American Institute of Mining, Metallurgical, and Petroleum Engineers, Inc., New York.

Non-Final Office Action dated Jan. 10, 2017 issued in U.S. Appl. No. 14/533,843.

Wenfang C. et al., "Preparation and Mechanical Properties of Ultra High Purity Fe—Cr Alloy", Gold Journal, vol. 3, No. 2, Jun. 2001, pp. 81-85.

Chinese Office Action dated Mar. 27, 2018, issued in Chinese Patent Application No. 201580060203.2, and English translation thereof, 16 pages.

Singapore Written Opinion dated Mar. 16, 2018 issued during the prosecution of Singapore Patent Application No. 11201702030T, 6 pages.

Non-Final Office Action dated May 17, 2018, issued in U.S. Appl. No. 15/463,217.

Chinese Office Action dated May 31, 2018, issued in Chinese Patent Application No. 201580060224.4, and English translation thereof, 28 pages.

Murray, G.T. et al., "Preparation and Characterization of Pure Metals, Properties and Selection: Nonferrous Alloys and Special-Purpose Materials," vol. 2, ASM Handbook, ASM International, 1990, pp. 1093-1097 (Year: 1990).

Search Report and Written Opinion Issued in Singapore Application No. 11201702084W dated Jun. 26, 2018.

R.N. Caron and J.T. Staley, Effects of Composition, Processing, and Structure on Properties of Nonferrous Alloys, Materials, Selection and Design, vol. 20, ASM Handbook, ASM International, 1997, pp. 383-415 (print version), pp. 1-12 pages (online version).

European Office Action dated Jul. 10, 2018, issued during the prosecution of European Patent Application No. 15864318.9 (3 pages).

Chilean Office Action dated Sep. 12, 2018 issued in Chilean Patent Application No. 201701132, and English translation thereof, 13 pages.

Final Office Action dated Oct. 4, 2017, issued in U.S. Appl. No. 14/533,741.

Non-Final Office Action dated Jun. 16, 2017, issued in U.S. Appl. No. 14/533,741.

Chilean Office Action issued in Chilean Patent Application No. 201701134, dated Oct. 16, 2018, and English translation thereof.

U.S. Appl. No. 15/403,273, filed Jan. 11, 2017. (year: 2017).

U.S. Appl. No. 14/533,843, filed Nov. 5, 2014. (year: 2014).

Non-Final Office Action dated Nov. 30, 2018, issued in U.S. Appl. No. 15/403,273.

U.S. Appl. No. 15/463,217, filed Mar. 20, 2017. (year: 2017).

U.S. Appl. No. 14/533,741, filed Nov. 5, 2014. (year: 2014).

(56) References Cited

OTHER PUBLICATIONS

Japanese Office Action, Notification of Reasons for Refusal dated Oct. 17, 2019, issued durng the prosecution of corresponoding Japanese Patent Application No. P2017-522511.
Australian Examination Report dated Apr. 17, 2020, issued during the prosecution of Australian Patent Application No. 2015376067.
Chinese Office Action and English translation thereof, dated Apr. 3, 2020, issued during the prosecution of Chinese Patent Application No. CN 201910030767.1.
Chinese Office Action and English translation thereof, dated Apr. 14, 2020, issued during the prosection of Chinese Patent Application No. CN 201580060203.2.
Japanese Office Action, Notification of Reasons for Refusal and English translation thereof dated, Oct. 17, 2019, issued during the prosecution of Japanese Patent Application No. JP 2017-522511.
Japanese Office Action and English translation thereof, dated Oct. 15, 2019, issued during the prosecution of Japanese Patent Application No. 2017-522510.
Murakami Yotaro, "New Technology And New Materials Research And Development of Cr-based Alloy Superior To Casted Ni-based Superalloy," NMC News, 2004, vol. 8(7), p. 1.
Final Notification of Reasons for Refusal issued in Japanese Application No. P2017-522510 dated Jun. 30, 2020 and English Translation.
Final Notification of Reasons for Refusal issued in Japanese Application No. P2017-522511 dated Jun. 30, 2020 and English Translation.
European Office Action issued in European Patent Application No. 19168262.4 dated Jun. 22, 2020.
First Examination Report issued in Australian Application No. 2015376120 dated May 11, 2020.
Non-Final Office Action dated Nov. 21, 2019 issued in U.S. Appl. No. 15/403,273.
Final Office Action dated May 6, 2020 issued in U.S. Appl. No. 15/403,273.
Chinese Office Action dated Jul. 29, 2021 issued in Chinese Application No. 201910030767.1.
Brazilian Office Action issued in BR Application No. BR122019024882-6 published Apr. 27, 2021 in Official Gazette No. 2625.
Peruvian office action and English translation thereof, dated Mar. 18, 2021, issued during the prosecution of Peruvian Patent Application No. 000487-2017/DIN.
Peruvian office action and English translation thereof, dated Jun. 1, 2021, issued during the prosecution of Peruvian Patent Application No. 000486-2017/DIN.
Chinese Office Action and English translation thereof, dated Jan. 22, 2021, issued during the prosecution of Chinese Patent Application No. 201910030767.1.
Requisition by the Examiner from the Canadian Intellectual Property Office for Canadian Patent Application No. CA2960576, dated Oct. 7, 2021.
Requisition by the Examiner from the Canadian Intellectual Property Office for Canadian Patent Application No. CA2960711, dated Oct. 14, 2021.
European Office Action issued during prosecution of related European Patent Application No. 19168262.4 dated Nov. 15, 2021. 4 pages.

PROCESSES FOR PRODUCING LOW NITROGEN METALLIC CHROMIUM AND CHROMIUM-CONTAINING ALLOYS AND THE RESULTING PRODUCTS

CROSS REFERENCE TO RELATED APPLICATIONS

The present application is a continuation application of U.S. patent application Ser. No. 15/463,217 filed on Mar. 20, 2017, which is a divisional application of U.S. patent application Ser. No. 14/533,741 filed on Nov. 5, 2014, issued as U.S. Pat. No. 10,041,146 on Aug. 7, 2018, the entire contents of which is incorporated herein by reference.

BACKGROUND OF THE INVENTION

1. Field of the Invention

The present invention relates to metallothermic processes for producing metallic chromium and its alloys. More specifically, the present invention relates to metallothermic processes for producing low-nitrogen metallic chromium and chromium-containing alloys and to the products obtained by said processes.

2. Description of Related Art

The lifespan of rotating metal parts in aircraft engines is typically determined by fatigue cracking. In this process, cracks are initiated at certain nucleation sites within the metal and propagate at a rate related to the material characteristics and the stress to which the component is subjected. That, in turn, limits the number of cycles the part will withstand during its service life.

Clean melting production techniques developed for superalloys have given rise to the substantial elimination of oxide inclusions in such alloys to the extent that nowadays, fatigue cracks are mainly originated on structural features, for example, on grain boundaries or clusters of primary precipitates such as carbides and nitrides.

It has been found that the primary nitride particles formed during the solidification of alloy 718 (see alloy 718 specifications (AMS 5662 and API 6A 718))—which is one of the main alloys utilized in the production of aircraft engine rotating parts and for oil and gas drilling and production equipment—are pure TiN (titanium nitride) and that the precipitation of primary Nb—TiC (niobium-titanium carbide) occurs by heterogeneous nucleation over the surface of the TiN particles, thereby increasing the precipitate particle size. The particle size can be decreased by two means: either by lowering the carbon content as much as possible, or by lowering the nitrogen content.

Many commercial specifications for stainless steel, other specialty steels, and superalloys, establish minimum carbon content, usually in order to prevent grain boundary slipping at the service temperature. As a consequence, the only practical means to decrease particle size compositionally is to reduce the nitrogen content in the material as extensively as possible. In that way, in as much as the nitrides precipitate first, removing nitrogen supersedes the importance of removing carbon.

It is known that removing the nitrogen and/or the nitrogen-containing precipitates after the reduction of a metal or metal alloy is an extremely difficult and expensive task. Therefore, nitrogen preferably should be removed before or during the reduction process.

There is a well known process for producing low nitrogen alloys called electron beam melting; it is very expensive and extremely slow when compared to a metallothermic reduction process and therefore, impractical from a commercial point of view. There is also a known aluminothermic reduction process (see, U.S. Pat. No. 4,331,475) which, as opposed to embodiments of the present invention, is not conducted under continuous reduced pressure resulting, at best, in a chromium master alloy, with a reduced nitrogen content of 18 ppm which, when used in alloy 718 production, cannot guarantee an alloy 718 whose nitrogen content is below the solubility limit of the titanium nitride precipitate.

SUMMARY OF THE INVENTION

In order to overcome the above-mentioned problems, which have plagued the aircraft and oil and gas industries for years, the present invention provides processes for producing low-nitrogen metallic chromium or chromium-containing alloys which prevent the nitrogen in the surrounding atmosphere from being carried into the melt and being absorbed by the metallic chromium or chromium-containing alloy during the metallothermic reaction. To such end, the processes of the present invention comprise the steps of: (i) vacuum-degassing a thermite mixture comprising metal compounds and metallic reducing powders contained within a vacuum vessel, (ii) igniting the thermite mixture to effect reduction of the metal compounds within the vessel under reduced pressure i.e., below 1 bar, and (iii) conducting the entire reduction reaction in said vessel under reduced pressure, including solidification and cooling, to produce a final product with a nitrogen content below 10 ppm.

In a first aspect of the processes of the present invention, the vacuum vessel can be a ceramic or metallic container lined with a refractory material.

In a second aspect of the processes of the present invention, the vacuum vessel is placed inside a vacuum-tight, water-cooled chamber, preferably a metallic chamber.

In a third aspect of the processes of the present invention, the pressure within the vacuum vessel is reduced, before ignition, to a pressure of less than about 1 mbar. And then, the pressure can be raised within the vessel through introduction of a non-nitrogenous gas, up to about 200 mbar to facilitate removal of by-products formed during the thermite reaction.

In a fourth aspect of the processes of the present invention, the resulting reaction products are solidified under a pressure below 1 bar.

In a fifth aspect of the processes of the present invention, the resulting reaction products are cooled to about ambient temperature under a pressure below 1 bar.

The present invention also provides:

Metallic chromium or chromium-containing alloys with a nitrogen content below 10 ppm.

The low-nitrogen metallic chromium and chromium-containing alloys with nitrogen content below 10 ppm are obtained through use of the above-mentioned processes of the present invention.

DETAILED DESCRIPTION OF THE PREFERRED EMBODIMENTS

Embodiments of the present invention provides processes for the production of low-nitrogen metallic chromium or low-nitrogen chromium-containing alloys comprising vacuum degassing a thermite mixture of metal oxides or other metal compounds and metallic reducing powders, reducing the oxides or compounds of that mixture in a reduced pressure, low-nitrogen atmosphere, thereby resulting in a metallic product with 10 ppm or less nitrogen in the produced weight.

Preferably, the thermite mixture comprises:

a) chromium oxides or other chromium compounds such as chromic acid and the like which can be reduced to produce metallic chromium and low-nitrogen chromium-containing alloys;

b) at least one reducing agent, such as aluminum, silicon, magnesium and the like, preferably in powder form;

c) at least one energy booster, such as a salt, e.g., $NaClO_3$, $KClO_4$, $KClO_3$, and the like, and/or a peroxide such as $CaO_2$ and the like, to provide high enough temperatures within the melt to insure good fusion and separation of metal and slag.

The processes of the embodiments of the present invention optionally include metallothermic reduction of chromium oxides or other chromium compounds such as chromic acid and the like to produce the metal or the reduction of chromium oxides or other chromium compounds together with other elements such as nickel, iron, cobalt, boron, carbon, silicon, aluminum, titanium, zirconium, hafnium, vanadium, niobium, tantalum, molybdenum, tungsten, rhenium, copper and mixtures thereof in their metallic form or as compounds thereof capable of metallothermic reduction.

Preferably, the reducing agent of the proposed mixture can be aluminum, magnesium, silicon, and the like; preferably, aluminum is employed in powder form.

The thermite reaction is carried out by charging the mixture to a ceramic or metallic vacuum vessel, preferably lined with refractory material. The vessel is placed inside a vacuum-tight, water-cooled chamber preferably, a metallic chamber, linked to a vacuum system. The vacuum system will remove the air within the vessel until the system achieves a pressure preferably lower than 1 mbar.

After achieving the reduced pressure condition, preferably lower than 1 mbar to assure removal of the nitrogen-containing atmosphere, the pressure within the system can be raised using a non-nitrogenous gas such as an inert gas, e.g., argon, or oxygen and the like, to a pressure up to about 200 mbar to facilitate removal of by-products formed during the thermite reaction. Once the thermite mixture is ignited, the pressure rises with the evolution of gases formed during the reaction, and, as the reaction products solidify and cool, the volume of the gases formed as a result of the reaction contracts and the pressure decreases but is always below 1 bar. In this manner, the reduction process is completed under reduced pressure over a period of time commensurate with the load weight, typically a few minutes. The process results in the formation of metallic chromium or a chromium-containing alloy containing below 10 ppm nitrogen. This is most important since there is ample evidence of the remarkable difficulty to remove nitrogen once it is present in chromium metal or chromium-containing alloys, even by resorting to techniques such as the much more expensive electron beam melting process.

The products obtained by the processes described above are permitted to solidify and cool down to about ambient temperature under the same low-nitrogen reduced pressure atmosphere so as to avoid nitrogen absorption in these final stages. It is considered critical in achieving the low nitrogen content metals and alloys of the embodiments of the present invention that the entire process from pre-ignition, ignition, solidification and cooling be conducted under reduced pressure as described herein.

Preferably, the metals or alloys produced will contain less than about 5 ppm nitrogen by weight. Most preferably, the metals or alloys produced will contain less than about 2 ppm nitrogen by weight.

The embodiments of the present invention further includes the products obtained by the processes described above in addition to low-nitrogen metallic chromium in combination with any other elements, which can be used as raw materials in the manufacture of superalloys, stainless steel or other specialty steels obtained by any other process, whose final content of nitrogen is below 10 ppm.

EXAMPLES

The following examples were conducted to establish the effectiveness of the embodiments of the present invention in obtaining low nitrogen chromium and chromium alloys.

In the following examples, an aluminothermic reduction reaction was effected in the manner disclosed below. Table 1 summarizes the composition of the materials charged to the reactor:

| | Example 1 Nb17-Cr68-Ni15 | | Example 2 Nb17-Cr68-Ni15 | |
|---|---|---|---|---|
| Target Alloy | (g) | (%) | (g) | (%) |
| $Nb_2O_5$ | 267 | 10.6 | 795 | 10.6 |
| $Cr_2O_3$ | 1093 | 43.4 | 3249 | 43.3 |
| $N_i$ | 165 | 6.5 | 490 | 6.5 |
| $KClO_4$ | 160 | 6.3 | 477 | 6.4 |
| Al | 571 | 22.6 | 1697 | 22.6 |
| CaO | 265 | 10.5 | 789 | 10.5 |
| Total | 2521 | 100.0 | 7497 | 100.0 |

In each example, the raw materials were charged to a rotating drum mixer and homogenized until the reactants were uniformly dispersed throughout the entire charge.

The vacuum chamber system was divided in an interior vacuum vessel and an external surrounding chamber. The interior vacuum chamber vessel was protected with a refractory lining to prevent overheating and to support the reactor vessel. The external chamber was made of steel and had a serpentine water conduit coiled in heat exchange relationship about it to cool and prevent its overheating as well as three ports integral therewith: a) an outlet for inner atmosphere removal; b) an inlet to permit backfilling with a non-nitrogenous gas; and c) an opening to connect the electrical ignition system with a power generator.

The reactor vessel was carefully placed inside the surrounding chamber and then was charged with the reaction mixture under the protection of an exhaustion system for dust removal.

Finally, the electrical ignition system was connected and the vacuum chamber was sealed.

The system had its inner atmosphere evacuated to 0.6 millibar (mbar) and was then backfilled with argon to a pressure of about 200 mbar. Then, the mixture was ignited with the electrical igniter inside the chamber under the low pressure inert atmosphere.

The aluminothermic reduction reaction took less than 3 minutes and gave rise to 800 mbar as the peak pressure and 1200° C. as the peak temperature.

Finally, the chromium alloy was removed from the reaction vessel after complete solidification and cooling under the low pressure inert atmosphere. The nitrogen content in the chromium alloy of Example 1 was 0.5 ppm and in Example 2 was 0 ppm.

Therefore, embodiments of the present invention provide processes conducted in a ceramic or metallic vacuum vessel with a refractory, e.g., ceramic, lining placed in a vacuum-tight, water-cooled chamber wherein the initial pressure is reduced under vacuum to a pressure less than about 1 mbar. With this equipment configuration, the extremely high temperature generated by the heat released by the thermite reaction is not a limiting factor for its feasibility, nor is the heat quantity carried by the gases and vapors generated in these processes.

The processes of embodiments of the present invention achieve extremely low nitrogen contents due to the fact that these processes are conducted entirely in a reduced pressure environment, i.e., below 1 bar, encompassing all phases of pre-ignition, ignition, solidification, and cooling.

Numerous variations of the parameters of embodiments of the present invention will be apparent to those skilled in the art and can be employed while still obtaining the benefits thereof. It is thus emphasized that the present invention is not limited to the particular embodiments described herein.

The invention claimed is:

1. Processes for producing metallic chromium or chromium-containing alloys comprising:

vacuum-degassing a thermite mixture comprising chromium compounds and metallic reducing agents, contained within a vacuum vessel capable of withstanding a thermite reaction;

igniting the thermite mixture to effect reduction of the chromium compounds within said vessel;

solidifying the reaction products; and cooling the reaction products to ambient temperature under a pressure below 1 bar, wherein igniting, solidifying and cooling are conducted under a pressure below 1 bar, wherein the produced metallic chromium or chromium-containing alloys have a nitrogen content less than 10 ppm by weight.

2. Processes according to claim 1, wherein the vacuum vessel is a ceramic or metallic container lined with refractory material.

3. Processes according to claim 2, wherein the vacuum vessel is placed inside a vacuum-tight, water-cooled chamber for the entire reduction reaction.

4. Processes according to claim 1, wherein the reducing agent is aluminum.

5. Processes according to claim 4, wherein the aluminum reducing agent is in powder form.

6. Processes according to claim 1, wherein the thermite mixture additionally comprises at least one energy booster.

7. Processes according to claim 1 wherein the thermite mixture additionally contains an element selected from the group consisting of nickel, iron, cobalt, boron, carbon, silicon, aluminum, titanium, zirconium, hafnium, vanadium, niobium, tantalum, molybdenum, tungsten, rhenium, copper, and mixtures thereof in their metallic form or as compounds thereof capable of metallothermic reduction.

8. Processes according to claim 1, wherein after vacuum-degassing and before ignition, the pressure within the vacuum vessel is increased up to 200 mbar by introduction of a non-nitrogenous gas.

9. Processes according to claim 1, wherein the produced metallic chromium or chromium-containing alloys have a nitrogen content less than 5 ppm by weight.

10. Processes according to claim 1, wherein igniting the thermite mixture and solidifying the reaction products are conducted under a pressure up to 200 mbar.

11. Processes according to claim 1, wherein igniting the thermite mixture and solidifying the reaction products are conducted under a pressure of 200 mbar.

12. Processes according to claim 1, wherein vacuum-degassing the thermite mixture includes vacuum-degassing the thermite mixture to an initial pressure less than 1 mbar.

* * * * *